US006322390B1

(12) United States Patent
Takeuchi

(10) Patent No.: US 6,322,390 B1
(45) Date of Patent: Nov. 27, 2001

(54) COAXIAL CONNECTOR

(75) Inventor: Fumiko Takeuchi, Tomioka (JP)

(73) Assignee: Cosmo Industry Co., Ltd., Gunma-ken (JP)

( * ) Notice: Subject to any disclaimer, the term of this patent is extended or adjusted under 35 U.S.C. 154(b) by 0 days.

(21) Appl. No.: 09/690,443

(22) Filed: Oct. 18, 2000

(30) Foreign Application Priority Data

Oct. 21, 1999 (JP) ..... 11-300181
Dec. 1, 1999 (JP) ..... 11-341666
Mar. 1, 2000 (JP) ..... 12-055299

(51) Int. Cl.[7] ..... H01R 9/05
(52) U.S. Cl. ..... 439/578; 439/289
(58) Field of Search ..... 439/578, 289, 439/583, 584, 585

(56) References Cited

U.S. PATENT DOCUMENTS 3,295,095 * 12/1966 Kraus ..... 439/578
3,804,972 * 4/1974 Gommans et al. ..... 439/578
4,167,300 * 9/1979 Fischer et al. ..... 439/578

* cited by examiner

*Primary Examiner*—Tho D. Ta
(74) *Attorney, Agent, or Firm*—Townsend & Banta

(57) ABSTRACT

A high frequency coaxial connector is provided, in which the characteristic impedance thereof is matched with the adjoining coaxial cable, which can be firmly coupled thereto.

The high frequency coaxial connector of the present invention consists of a plug and jack having central conductor connecting means for directly conductively contacting exposed front ends of the central conductors, outer conductor connecting means for maintaining a predetermined distance from the central conductor so as to attain the same characteristic impedance (for example, 75 Ω) as that of the coaxial cable which conductively connect the outer conductors of the two coaxial cables with each other by a tubular member interposed therebetween, and fastening means for fastening and affixing the plug to the jack by the sliding of a taper portion of a mouth ring on the plug side and by fastening a depression on an connecting end side of the plug to a protrusion on the connecting end side of the jack.

7 Claims, 11 Drawing Sheets

COAXIAL CONNECTOR

FIELD OF THE INVENTION

The present invention relates to a coaxial connector, more particularly, to a high frequency coaxial connector, in which a characteristic impedance is ideally matched and which can be firmly, reliably and simply connected.

BACKGROUND OF THE INVENTION

In order to transmit a high frequency signal, a coaxial cable is generally employed, which comprises a central conductor composed of a single conducting wire, an insulator made of Teflon, phenol resin or the like, surrounding the central conductor, a mesh outer conductor surrounding the insulator and an insulator outer skin.

Characteristic impedance of this coaxial cable is defined by the diameter of the central conductor and the dielectric constant of the insulator located between the central conductor and the outer conductor. The characteristic impedance of a general coaxial connectors is classified roughly into two categories, namely 50 Ω systems and 75 Ω systems.

When above described coaxial cables are connected with each other, in general, a coaxial connector is employed, which is composed of a plug arranged on each end and a jack. With respect to one example thereof, a general purpose plug 2, as shown in FIG. 9, has a plug body A with a cylindrical shape and is composed of a conductor. One end of the plug body A is formed as an inlet B to be conductively connected to a jack (not illustrated).

Further, in the plug 1 shown in FIG. 9, a clamp C projects from the other end of the plug body A in a direction opposite of inlet B. The clamp C is caulked (or soldered in some cases) to the outer conductor, so that plug body A can be fixably attached to one end of a coaxial cable D. A connection terminal E (contact pin) is fastened to one end of the plug body A via the insulator so as to project from the end of plug 1. Further, a cap F is connected to the end of the plug body A opposite of connection terminal E to surround the clamp C.

The plug 1 may be plugged into a jack which is fastened to the chassis of electrical equipment such as a TV receiver or a video cassette recorder, or a jack positioned on the end of another coaxial cable so as to connect the two. When plugging in plug 2, the connection terminal E is inserted within a jack and the inlet B of the plug body is arranged so as to be fitted in the outer periphery of the conducting member of the jack. Such a jack would have a similar configuration as that of plug 1, except that it would have a shape suitable to accept insertion of connection terminal E and inlet B of the plug 1.

As described above, both the plug and the jack of the conventional coaxial connector are soldered to a connection terminal (contact pin), wherein the central conductor of the coaxial cable D is thicker than the connection terminal itself, so that the connection terminals are conductively connected with each other.

The above arrangement is also employed in a coaxial connector for high frequency. The process of making such a coaxial connector is shown in FIGS. 10(*a*) through 10(*f*). For example, as shown in FIG. 10(*a*), an outer insulator skin 3 of the coaxial cable D is cut and a turnbuckle 12, a bushing 13, a band 14 are inserted therein. As shown in FIG. 10(*b*), after a clamp 6 is inserted between the outer conductor 4 and the outer insulator skin 3, then the outer conductor 4 is folded back to define a gap region between outer conductor 4 and insulator 5, and a collar 7 is inserted into this gap.

Next, as shown in FIG. 10(*c*), the outer conductor 4 is stripped away with a cutter at the front end of clamp 6 on the border of collar 7 and the insulator 5 is stripped away from the front end of collar 7 without damaging the central conductor 8. Then, as shown in FIG. 10(*d*), the arrangement in FIG. 10(*c*) is inserted into a first cylindrical body 9 of the conductor, in which a connection terminal 16 is arranged via an insulator 15 (which may be made of a phenol resin).

Engaging a slit of the first cylindrical body 9 and a slit of the clamp 6, the outer conductor 4 is soldered to the portion of the first cylindrical body 9 represented by reference numeral Hi, and a front end of the central conductor 8 and a connection terminal 16 are soldered (a portion represented by a reference numeral H2) by inserting a soldering bit from a window portion of the first cylindrical body 9. Next, as shown in FIG. 10(*e*), the band 14 is caulked to a collar of the clamp 6. Finally, as shown in FIG. 10(*f*), the jack is inserted into a second cylindrical body 18 of the conductor and fastened thereto by the turnbuckle 12, so that the bushing 13 maintains the band 14 in contact and pressed against the outer conductor 4.

As demonstrated in the above examples, all of the conventional coaxial connectors are connected with each other such that the central conductors 8 are connected via connection terminals (contact pins). Therefore, it is necessary to solder the central conductors 8 to the connection terminals through windows located in the plug and the jack. This work is very troublesome, and is problematic in that the insulator 15 may possibly be melted by the heat produced by soldering, thereby cause a short circuit between the outer conductor 4 and the central conductor 8.

Further, as the manufacturing and wire connecting process of the plug and jack are difficult and time consuming, the cost of manufacturing is increased.

As described above, the characteristic impedance of the coaxial cable D is determined by the diameter of the central conductor 8, the inside diameter of the outer conductor 4 and the dielectric constant of the insulator 5 therebetween. Conventionally, since the connection terminal 16 interposes in the coaxial connector, as a wire connection means of the central conductor 8, the portion where the connection terminal 16 interposes is thicker, and there is a region (air region having a dielectric constant which is different from that of the insulator 5) without insulators around the connection terminal 16. Due to this, it is necessary to enlarge the diameter of the coaxial connector to provide correct matching of the characteristic impedance.

In the case of a transmission path of a high frequency signal, when the impedance passes through different channel paths, reflection results. In order to increase transmission efficiency, it is necessary to prevent this reflection as much as possible. Since the coaxial cable is a link in the channel path, it is important that the connector itself be designed so as to have an identical characteristic impedance as that of the coaxial cable (typically, 50 Ω or 75 Ω).

In other words, matching of the characteristic impedance of the coaxial cable and coaxial connector is required to meet the above objectives. However, in conventional coaxial connectors, ideal impedance matching between coaxial connectors and coaxial cables has not yet been achieved.

SUMMARY OF THE INVENTION

The present invention has been made taking the above problems into consideration, and an object thereof is to provide a coaxial connection having ideal matching of the characteristic impedance, a configuration enabling direct connection with conductive front edges of the central conductors of the opposing coaxial cables without interposing high frequency connection terminals therebetween, and to conductively connect the outer conductors with each other by providing tubular members in the plug and jack for coupling the outer conductors with each other without substantially changing their inside diameters.

In order to attain the above described objects, the present invention provides, in a first embodiment, a coaxial connector for connecting two end portions of a coaxial cable, the coaxial connector being composed of a plug with a connecting end side and non-connecting end side, a jack with a connecting end side and a non-connecting end side, a central conductor, an inner insulator surrounding the central conductor, an outer conductor surrounding the inner insulator, and an outer insulator skin surrounding the outer conductor, wherein the plug and jack form the central conductor connecting means for directly conductively contacting front ends of the central conductors of the plug and jack, whose surfaces are exposed and surrounded by the insulator of the coaxial cable; outer conductor connecting means for maintaining a predetermined distance between the central conductor and the jack or plug so as to maintain the same characteristic impedance as that of the coaxial cable and for conductively connecting the outer conductors with each other by positioning a tubular member therebetween; and a coupling means for fastening and fixing the plug to the jack.

According to the present invention, a coaxial connector is provided, in a second embodiment, having a plug with a connecting end side and a non-connecting end side, a jack with a connecting end side and a non-connecting end side, a central conductor connecting means, a depression in the non-connecting end side of the plug and jack having a cable insertion hole with substantially the same diameter as the outer diameter of the coaxial cable; a gap defined at the connecting end side of the plug to which the coaxial cable is connected; and an insertion hole having a diameter equal to that of the diameter of the insulator of the coaxial cable at the connecting end side of the jack, and having a protrusion therein.

A third embodiment of the coaxial connector of the present invention is provided according to the first embodiment above, comprising, as an outer conductor connecting means of the plug and the jack, a tubular member including a spring arranged within the plug and jack being inserted around the outer insulator skin of the central conductor, a shield cover having a force applied on one end thereof by the spring, inserted around the outer conductor, and a washer with teeth for depressing and gripping the outer conductor whose edge is folded backed onto the shield cover.

A fourth embodiment of the coaxial connector of the present invention is provided according to the first embodiment above, further comprising an outer conductor connecting means of the plug and the jack, the outer conductor means being made up of a tubular member and a retaining ring, the tubular member consisting of a shield cover provided with a taper region arranged within the plug and jack and being inserted around the outer insulator skin of the central conductor and around the exposed outer conductor, wherein the taper region of the shield cover depresses and grips a folded back portion of an end of the outer conductor, at one opening end, to the inside of the plug and jack, and the retaining ring having an insertion portion being inserted around the outer insulator skin being provided with a gap to be pressed into the taper of the shield cover.

In a fifth embodiment of the present invention, a coaxial connector is provided according to the first embodiment herein, further having a coupling means for fastening the plug to the jack, the coupling means consisting of a depression conductor member provided with a gap at the connecting end side of the plug, a protrusion conductor member on the connecting end side the jack capable of being fitted into the depression conductor member of the plug, a collet cap having a tubular body provided with a female thread arranged on the outer periphery of the plug, and a mouth ring having a taper portion for fastening an outer periphery of the depression conductor member on the inner periphery thereof.

In a sixth embodiment of the present invention according to the first embodiment above, a coaxial connector is provided, further having a coupling means for fastening the plug to the jack, the coupling means consisting of a depression conductor member being provided with a gap at the connecting side of the plug, a protrusion conductor member having an inverse taper provided on the connecting end side of the jack capable of being fitted into the depression conductor member of the plug, a collet cap having a tubular body provided with a female thread which is arranged on an outer periphery of the plug, and a mouth ring having a taper portion for fastening the outer periphery of the depression conductor member on the inner periphery.

In a seventh embodiment of the present invention according to the first embodiment above, as shown in FIGS. 6–7, a coaxial connector is provided according to the first embodiment herein, wherein the plug and jack further have fixing means for fastening the inner periphery of the plug and jack to the outer insulator skin at a plurality of points, the fixing means having a plurality of tubular wedge-shaped retaining members internally mounted in the coaxial connector which engage coupling means at the taper portion of the wedge in a gap and/or a slit, thereby affixing a coaxial cable to the coaxial connector by exerting a force thereon.

BRIEF DESCRIPTION OF THE DRAWINGS

FIG. 10(*b*) is cross-sectional side view of a jack of a conventional high frequency coaxial connector during the second stage of the manufacturing and wire connecting process;

FIG. 10(*c*) is cross-sectional side view of a jack of a conventional high frequency coaxial connector during the third stage of the manufacturing and wire connecting process;

FIG. 10(*d*) is cross-sectional side view of a jack of a conventional high frequency coaxial connector during the fourth stage of the manufacturing and wire connecting process;

FIG. 10(*e*) is cross-sectional side view of a jack of a conventional high frequency coaxial connector during the fifth stage of the manufacturing and wire connecting process;

FIG. 10(*f*) is cross-sectional side view of a jack of a conventional high frequency coaxial connector during the sixth stage of the manufacturing and wire connecting process.

DETAILED DESCRIPTION OF THE INVENTION

Figure 3:
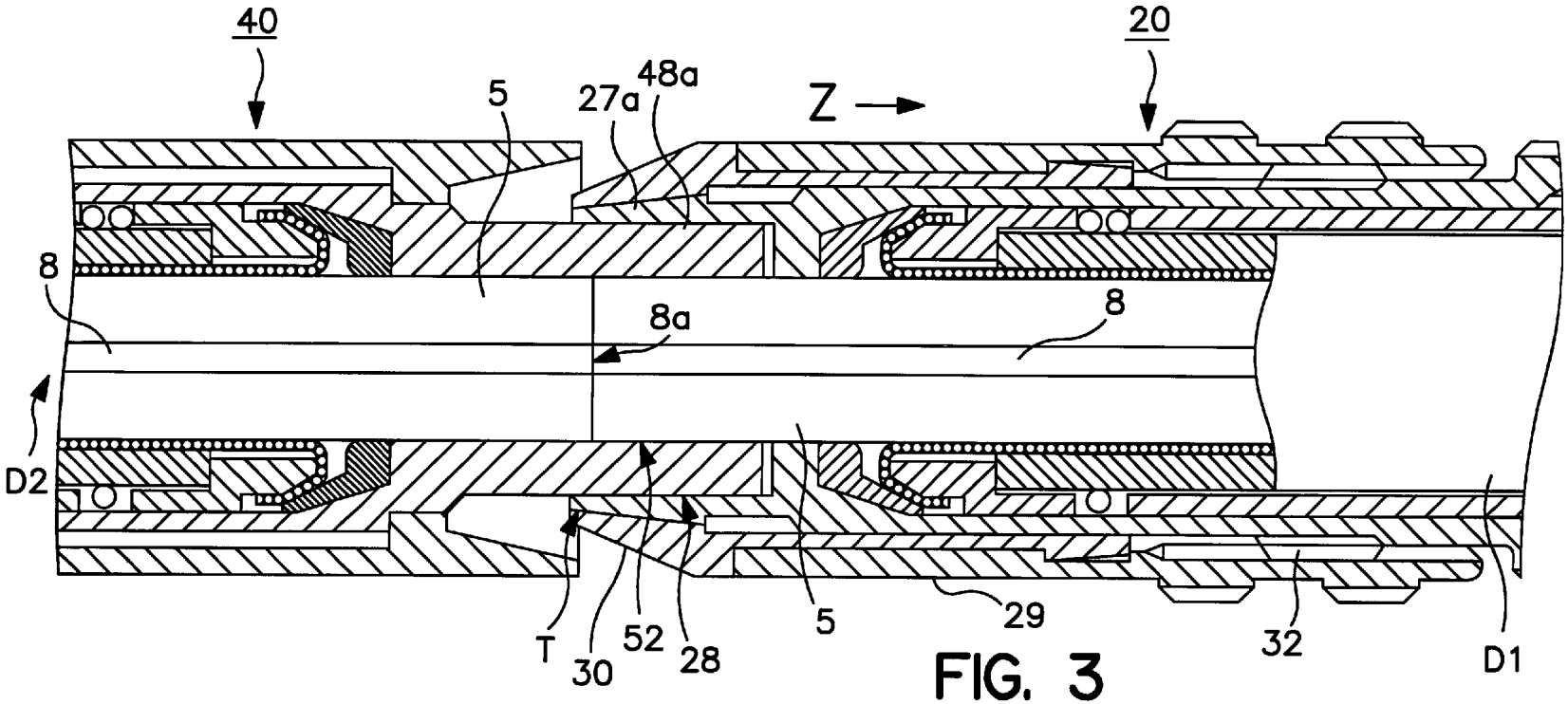
FIG. 3 is a cross-sectional side view of the plug and the jack of the coaxial connector of the first embodiment, showing the plug and jack attached to coaxial cables, in a connected state.

In the first embodiment, the plug 20 and the jack 40 comprise central conductor connecting means for directly conductively contacting wire connecting front ends of the central conductors 8. The front end surfaces 8*a* of central conductors 8 are exposed, but surrounded by the insulator 5 of the coaxial cables D1 and D2 as shown in FIG. 3. Outer conductor connecting means are provided for maintaining a predetermined distance between the central conductor 8 and the plug or jack so as to maintain the same characteristic impedance (for example, 75 Ω) as that of the coaxial cable, and conductively connect the outer conductors with each other through a tubular member interposed therebetween. Finally, coupling means are provided for fastening and fixing the plug 20 to the jack 40.

Figure 1:
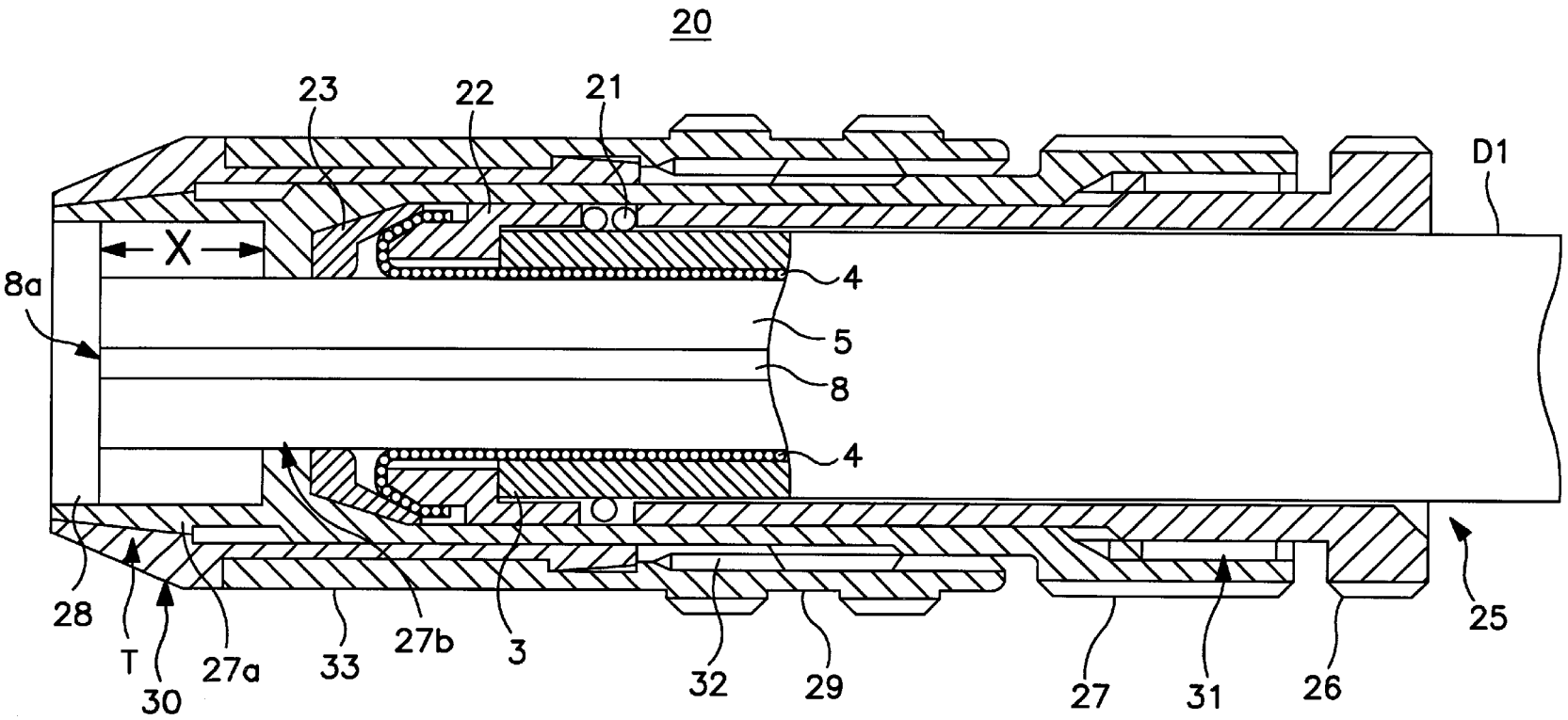
FIG. 1 is a cross-sectional side view of a plug of the coaxial connector according to the first embodiment of the present invention.

The plug 20, as shown in FIG. 1, has a first tubular shell 26 and a second shell 27, which act as the central conductor connecting means. The first tubular shell 26 has a cable insertion hole 25 having a diameter substantially the same as the outside diameter of the coaxial cable D1, and a thread portion 31 into which a male thread is screwed. The second shell 27 encircles the first shell 26, and has a depression 28 therein comprising an annular wall 27*a* in which a gap is defined at the connection end. In the second shell 27, a female thread and male thread engage one another in the thread portion 31.

The depression 28 comprises an inside diameter larger than that of the insulator 5 of the coaxial cable D1. Only a few millimeters of the end portion of the insulator 5 and the central conductor 8 at the connecting side of the coaxial cable D1 (represented by X1 in FIG. 1) project into the gap region defined by depression 28 and annular wall 27*a*.

Figure 2:
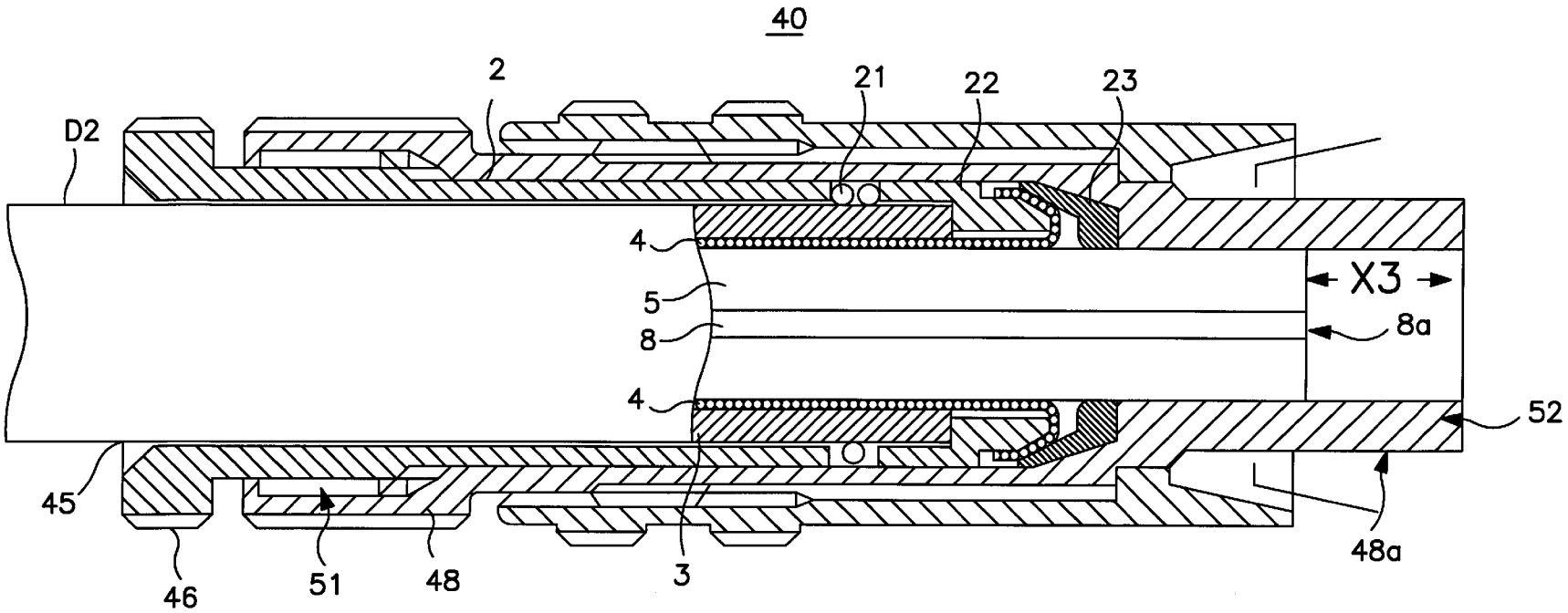
FIG. 2 is a cross-sectional side view of a jack of the coaxial connector of the first embodiment of the present invention.

The jack 40 shown in FIG. 2 has a first shell 46 and a second shell 48, acting as the central conductor connecting means. The first shell 46 has a cable insertion hole 45 having a diameter substantially the same as the outer diameter of the coaxial cable D2. The second shell 48 is arranged on the outside of the first shell 46 and is threadably engaged to the first shell 46 by thread portion 51. Second shell 48 has an insertion hole 52 having the same outside diameter as that of the insulator 5 of the coaxial cable D2. Further, the second shell 48 has a protrusion 48*a* fitting into the depression 28 of the plug 20 shown in FIG. 1. The first shells 26 and 46 and the second shell 27 and 48, of the plug and jack shown in FIGS. 1 and 2, respectively, have conductors made of brass or the like.

Thus, according to the central conductor connecting means, as shown in FIG. 3, consisting of the plug 20 shown in FIG. 1 and jack 40 shown in FIG. 2, the insulator 5 at the connecting end side of the coaxial cable D2 and the end portion of the central conductor 8, of the jack 40, are inserted into the insertion hole 52 of the plug to a depth of a few millimeters from the opening of the insertion hole 52 (represented by X2 in FIG. 2). As a result, the insulator 5 of coaxial cable D1 projecting into the depression 28 of the plug 20 and the end portion of the central conductor 8 of the plug 20 are inserted into the insertion hole 52 of the jack 40. Further, the depression 28 of plug 20 and the protrusion 48*a* of jack 40 are fitted substantially close to one another.

The front end surfaces of the respective central conductors 8 of the coaxial cables D1 and D2 are conductively contacted within the insertion hole 52 of the protrusion 48*a*. At the same time, the front end surfaces of insulator 5 are engaged with each other such that there is no region where the central conductor 8 is exposed. Therefore, there is no change of conductivity at the contact point. In other words, the coaxial cables D1 and D2 are connected as if they are composed of one unbroken line. In order to ensure that there is a conductive connection between the central conductors 8, it is important that the front end surfaces of the central conductors 8 are flat, and that the coaxial cables D1 and D2 are firmly pressed against one another so as to ensure a firm and conductive connection.

As shown in FIGS. 1–3, a tubular member 2 is provided in the outer conductor connecting means, consisting of a spring 21, a shield cover 22 and a washer 23 with teeth arranged within the plug 20 and the jack 40. The spring 21 is inserted around the outer insulator skin 3 of the coaxial cables D1 and D2. Pressure is exerted on the shield cover 22, inserted around outer conductor 4, by the spring 21, the outer conductor 4 being exposed by stripping away the insulator outer skin 3. The washer 23 compresses and folds back the outer conductor 4 against the shield cover 22.

Thus, the first shell 26 and the second shell 27 in the plug 20 are threadably engaged through thread portion 31, and the spring 21, the shield cover 22 and the washer 23 with teeth, positioned between the first shell 26 and the second shell 27, press the outer conductor 4 against the first shell 26. This shield cover 22 and the washer 23 with teeth act as metal conductors, and the interior diameter of the washer 23 with teeth and hole 27*b* in the bottom of the depression 28 of the second shell 27 are substantially the same as the outer diameter of insulator 5. Therefore, the outer conductor connecting means and the central conductor 8 are separated by a distance equal to the distance between the outer conductor 4 of the coaxial cable D1 and the central conductor 8.

Further, the teeth of the washing 23 are inclined in the direction of the connecting portion of the central conductor 8 in a manner so that the coaxial cable D1 can be easily inserted into the coaxial connector. This placement of the teeth prevent the coaxial cable D1 from slipping out of the coaxial connector by causing the teeth of the washer 23 to bite into the outer periphery of the coaxial cable D1. According to the above arrangement, it is possible to strongly and reliably affix the outer conductor 4 to the plug 20, which firmly connects and fixes the coaxial cable D1 thereto.

Also, by the same configuration described in plug 20 as above, the first shell 46 and the second shell 48 of the jack 40 are threadably engaged by thread portion 51, so that the outer conductor 4 of the coaxial cable D2 can be firmly connected and fixed to jack 40.

As described above, in the plug 20 and the jack 40, to which the outer conductors 4 of the coaxial cables D1 and D2 are connected and fixed, respectively, the outer conductors 4 conductively interact with each other by the central conductor connecting means when the protrusion 48*a* of the jack is fitted into depression 28 of the plug.

Such construction allows ease in pulling apart the coaxial cables D1 and D2 to separate them. On this account, it is necessary to provide coupling means for securing the protrusion 48*a* in the depression 28 by a coupling means. As this coupling means, as shown in coaxial connectors in FIGS. 1 and 2, the second shell 27 of the plug 20 acts as a depression conductor member, the second shell 48 of the jack 40 acts as a protrusion conductor member, and a collect cap 33 is provided. The second shell 27 defines an annular wall 27*a* with a shape similar to a collet, in which a gap is defined at the connecting end side of the plug 20. The second shell 48 of jack 40 is fitted into the depression 28 of the second shell 27 of the plug 20 at the connecting end side 47 of the jack 40. The body 29 is arranged on the outer periphery of the plug 20 and defines a female thread of the thread portion 32. The collet cap 33 rotatably pivots against a mouth ring 30 having a taper portion T for fastening the annular wall 27*a* of the depression conductor member on the inner periphery of plug 20.

As shown in FIG. 3, after fitting the depression 28 of the plug 20 over the protrusion 48*a* of the jack 40 so as to conductively connect the central conductors 8 with each other, the body 29 of the collet cap 33 in the plug 20 is rotated around and moved back towards the second shell 27 at the thread portion 32, so that the mouth ring 30 pulls back in the direction arrow Z, causing the taper portion T to depress the annular wall 27A against the outer periphery 48A of the protrusion 48. Thus, the depression 28 of the plug 20 and the protrusion 48*a* of the jack 40 are strongly affixed to each other. As a result, by using plug 20 and jack 40 of the coaxial connector of the first embodiment herein, coupling of the coaxial cables D1 and D2, while matching ideal characteristic impedance, can be simply and easily achieved without soldering.

Figure 4:
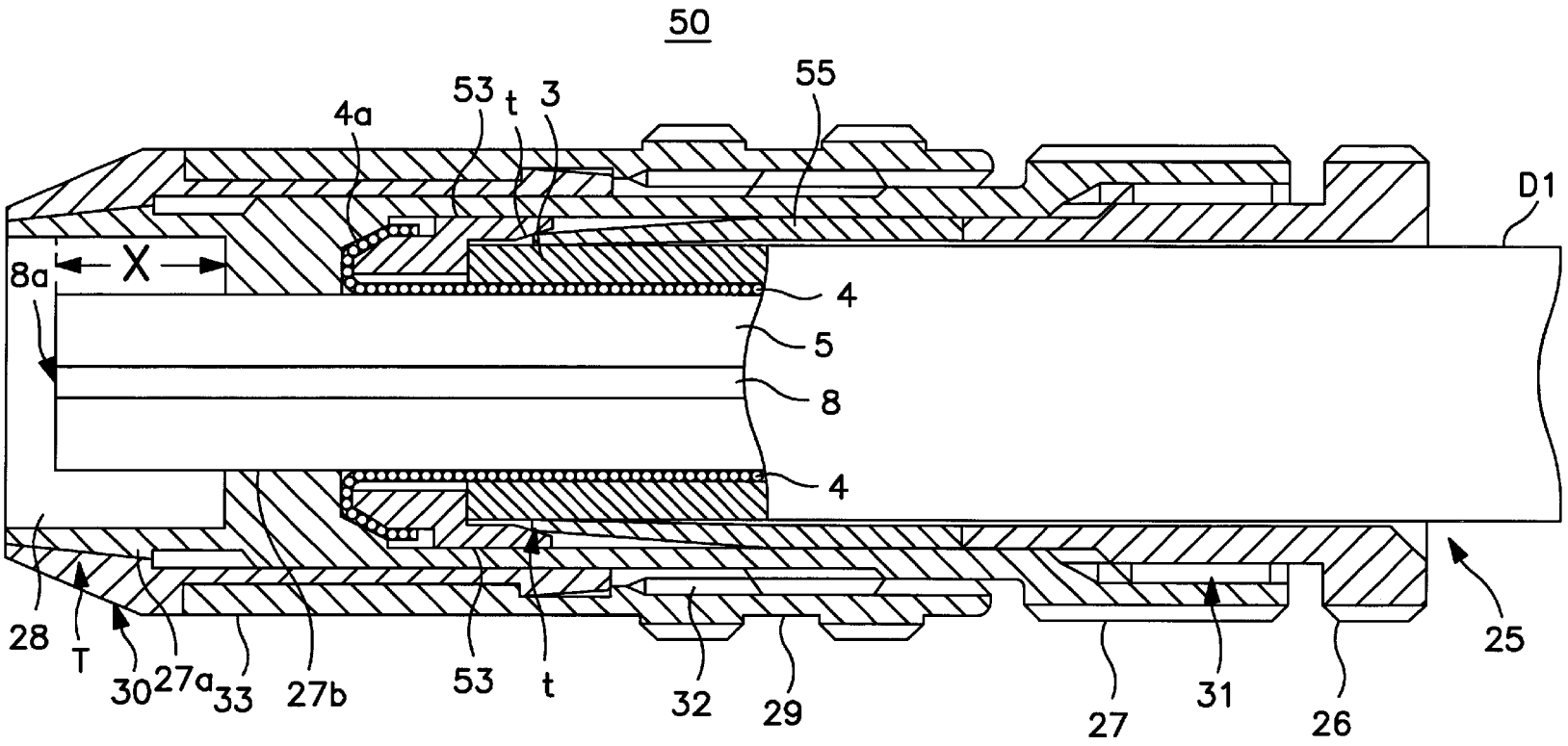
FIG. 4 is a cross-sectional side view of the plug of the coaxial connector of the second embodiment of the present invention.
Figure 5:
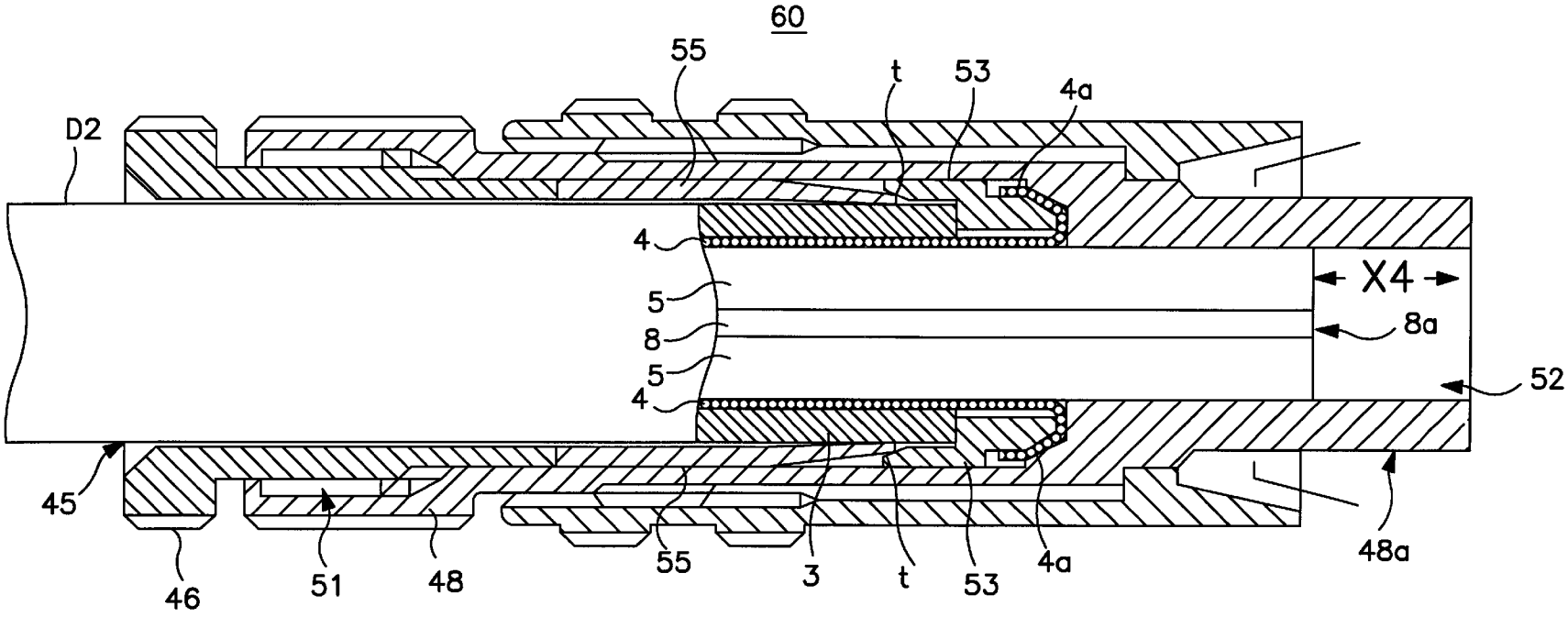
FIG. 5 is a cross-sectional side view of the jack of the coaxial connector of the second embodiment of the present invention.

In a second embodiment of the present invention, as shown in FIGS. 4–5, the outer conductor connecting means of plug 50 and jack 60 comprises a tubular member having a shield cover 53 and a retaining ring 55. The shield cover 53 is arranged within plug 50 and jack 60 and is inserted around the outer insulator skin 3 of the coaxial cable D1 and D2, and around the outer conductor 4 which is exposed by stripping away the insulator outer skin 3. The shield cover 53 also presses an end of the folded-back portion 4*a* of the outer conductor 4 of coaxial cable D1 and D2 against the inner surface of the plug or the jack at one end, and is provided with a taper t on the inner surface of the opposite end. The retaining ring 55 is inserted around the outer insulator skin 3 of the coaxial cable D1 and D2, and has a tapered end upon which the taper t of the shield cover 53 may be slidably depressed.

In plug 50 shown in FIG. 4, a gap in retaining ring 55 is defined by taper t in the shield cover 53, and the gentle taper in the front portion of retaining ring 55. The end of retaining ring 55 opposite taper t is deeply pressed into the plug 50 by engaging the first shell 26 with the second shell 27 via thread portion 31. Pressure on the insertion portion causes retaining ring 55 to press the shield cover 53 into the inner wall of the second shell 27, which in turn strongly depresses the outer periphery of the outer insulator skin 3 against the coaxial cable D1. This allows the coaxial cable D1 to be firmly fixed within the second shell 27 of the plug 50.

As shown in FIG. 5, jack 60 has the same configuration as that of plug 50, namely, having tubular members (the shield cover 53 and the retaining ring 55). In this configuration, the coaxial cable D2 is likewise firmly fixed within the second shell 48 of the jack 60.

According to the second embodiment of the present invention, in place of the spring 21 and the washer 23 with teeth in the previous embodiment, the retaining ring 55 and the taper t of the shield cover 53 are provided. The above described wedge effect permits enhanced fixing strength of the plug 50 and the jack 60 to the coaxial cables D1 and D2. Further, it is preferable that the front end surface 8*a* of central conductor 8, in which the outer insulator skin 3 is stripped from the coaxial cables D1 and D2, slightly projects from the front end of the insulator 5 positioned therearound by about 0.5 mm to ensure a proper conductive connection. It is desirable that a protruding length X3 of the insulator 5 of the coaxial cable D1 in the depression 28 at the connecting end of the plug 50, and a distance X4 from the opening of the coaxial cable D2 to the insertion hole 52 in the protrusion 48*a* of the connecting end side of the jack 60, are substantially identical to each other.

With regards to the conducting connection configuration, when pressing and connecting the central conductors 8 in the coaxial connector comprising the plug 20 (or 50) and the jack 40 (or 60) on the front end surface 8*a*, the tensile strength of the coaxial cables D1 and D2 must be tested with respect to reliability, and found to have a high level of reliability. In other words, the coaxial connector must maintain conductivity during horizontal loading and bending. In the horizontal loading test, a pulling stress of 10 kg is applied to the coaxial connector in the direction corresponding to the removal of the coaxial cable from the coaxial connector. In the bending loading test, the coaxial cable is bent from the root of the coaxial connector at a right angle with a force of 3 kg.

Figure 6:
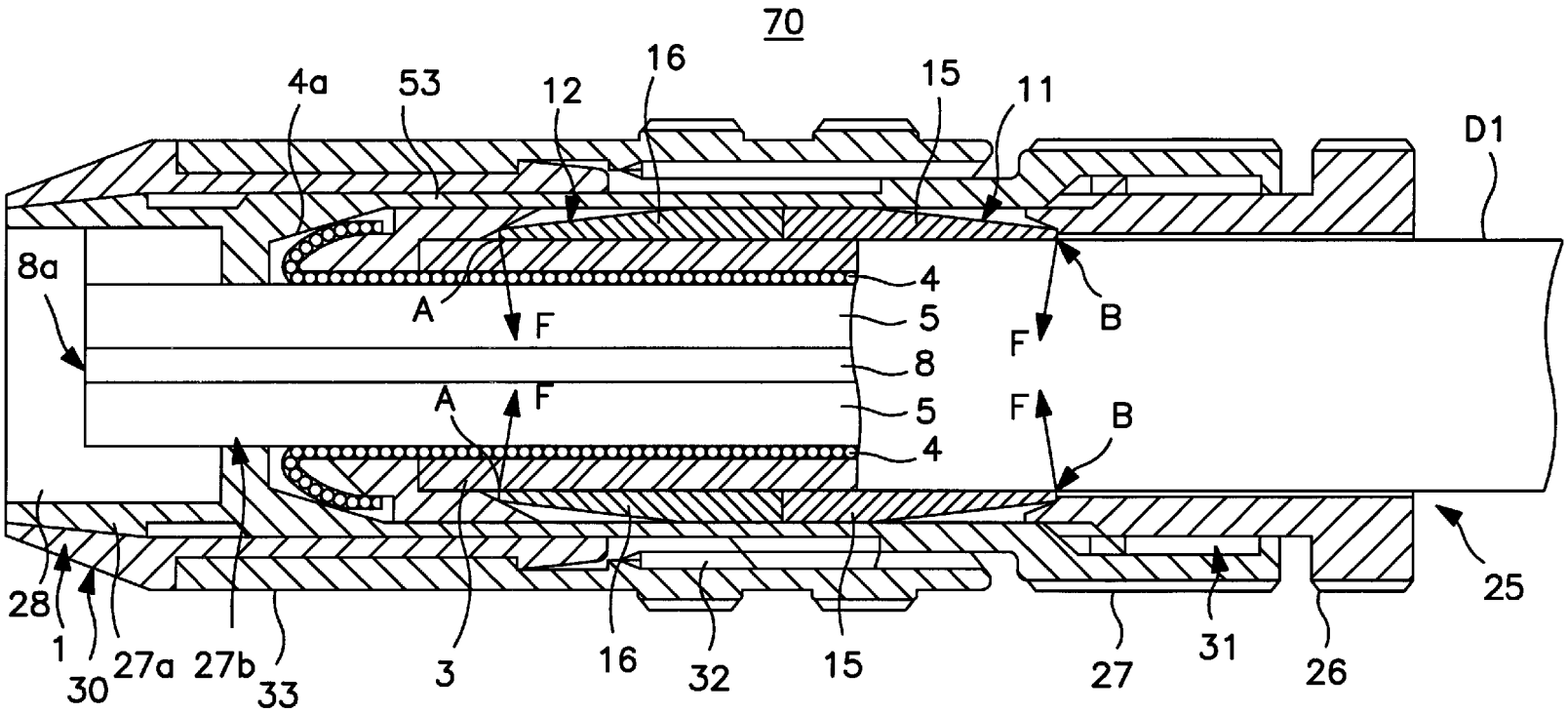
FIG. 6 is a cross-sectional side view of the jack of the coaxial connector of the third embodiment of the present invention.
Figure 8:
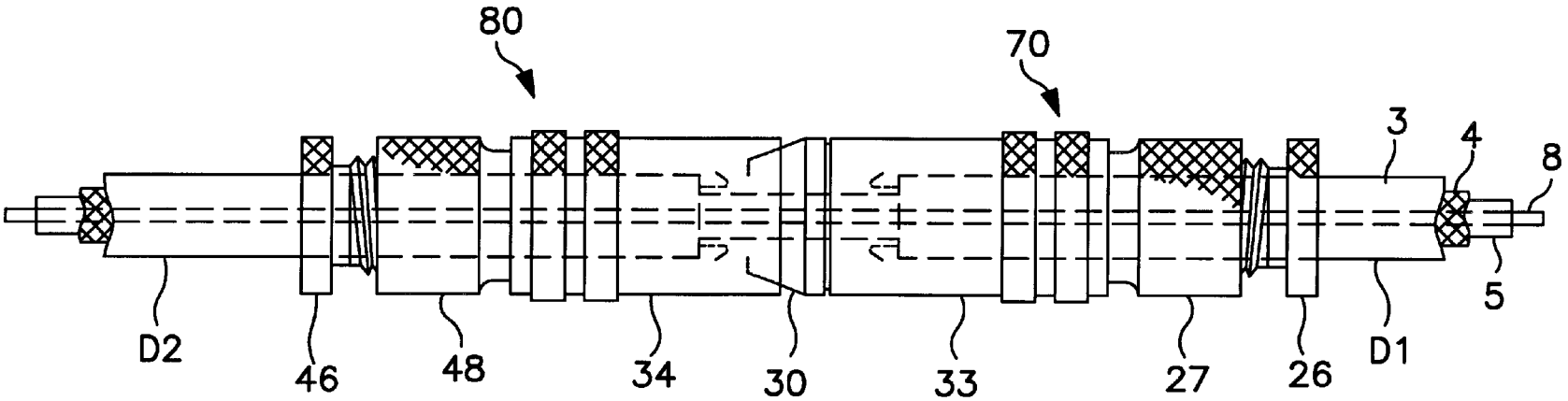
FIG. 8 is a transparent side view of the coaxial connector of the present invention.
Figure 9:
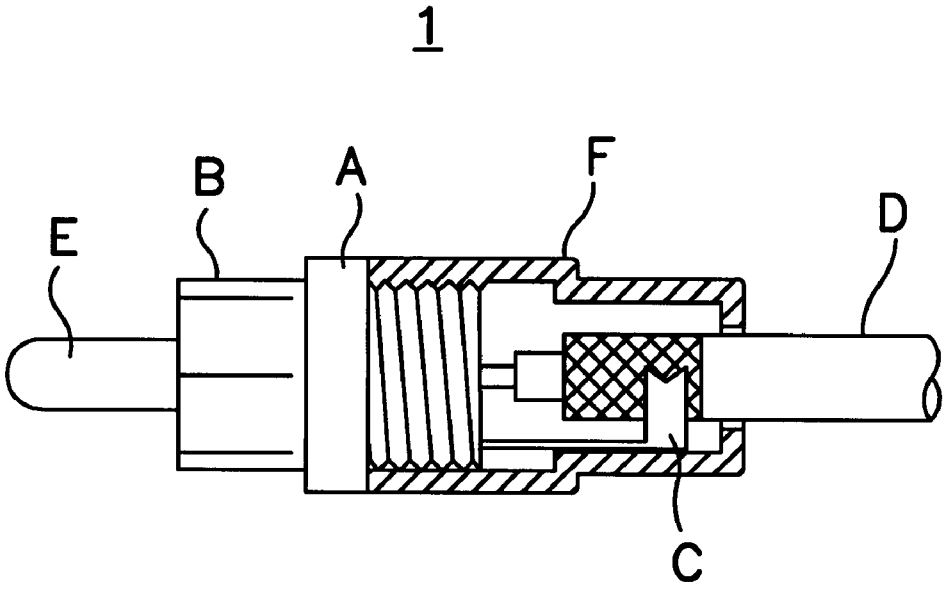
FIG. 9 is a cross-sectional side view partially cut away of a plug of a conventional general purpose coaxial connector.
Figure 10A:
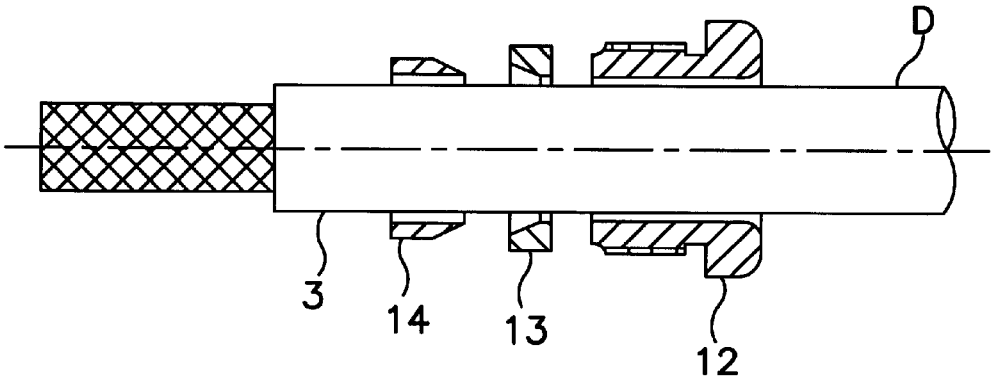
FIG. 10(*a*) is cross-sectional side view of a jack of a conventional high frequency coaxial connector during the first stage of the manufacturing and wire connecting process.
Figure 10B:
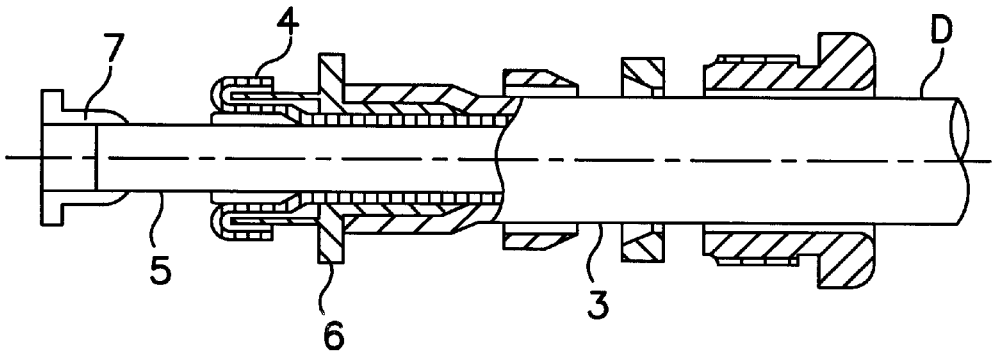
Figure 10C:
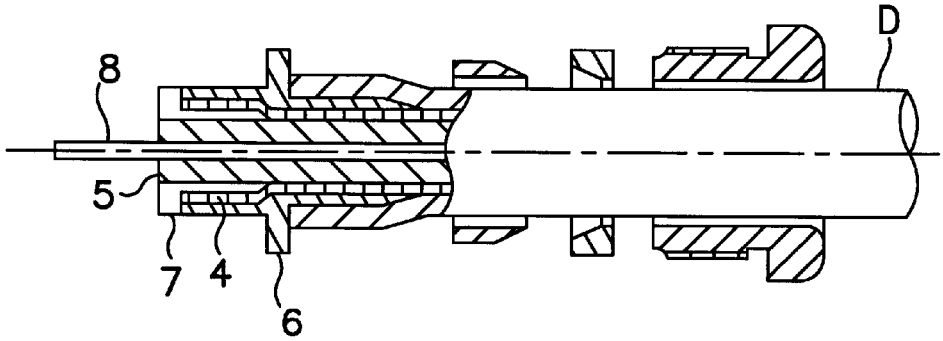
Figure 10D:
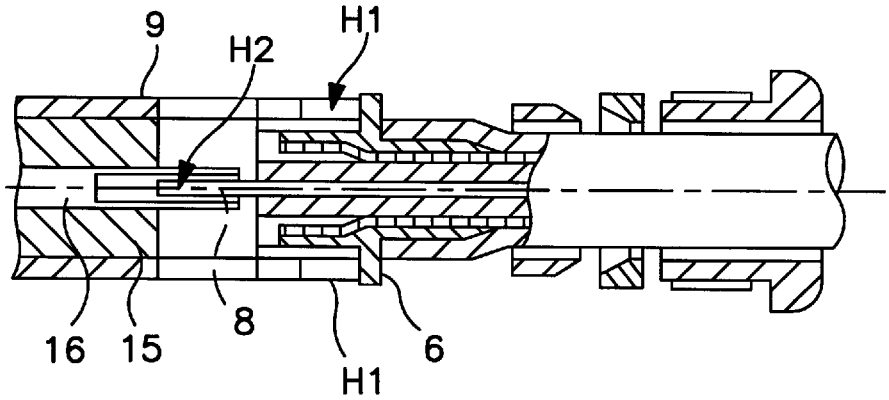
Figure 10E:
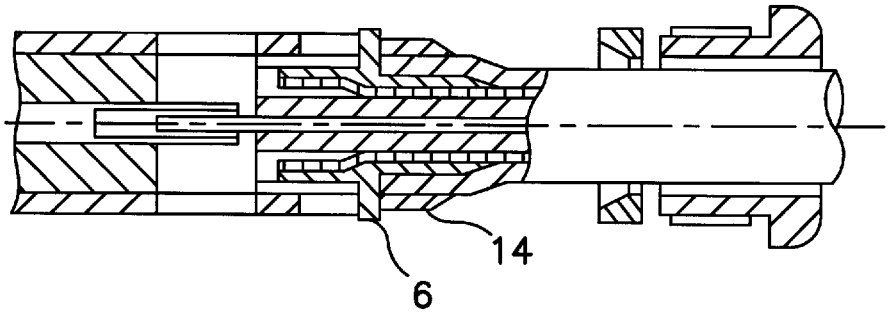
Figure 10F:
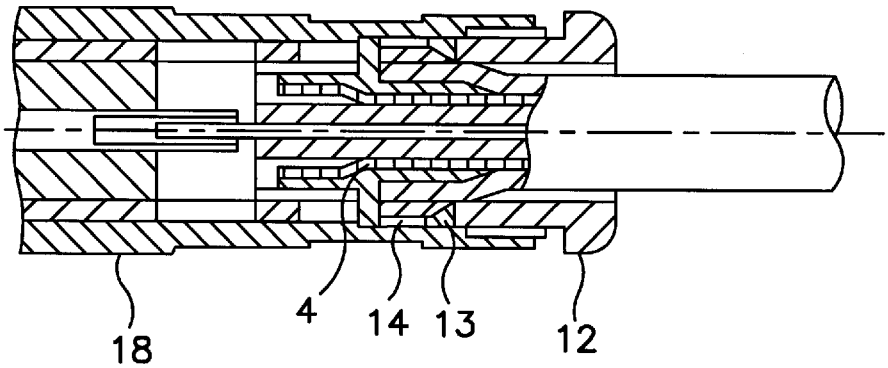
FIG. 10F PRIOR ART

On account of these requirements, in the jack 80 shown in FIGS. 6 and 8, a third embodiment of the present invention is provided such that an inverse taper t3 is provided on the protrusion 48*a* of the jack 80 to press against the depression 28 of the plug 70, providing a firm and reliable coupling means suitable for fastening the plugs 20 and 50 to the jacks 40 and 60. According to the above configuration, for example, when the annular wall 27*a* of the plug 70 presses against the surface of the inverse taper t3 of the protrusion 48*a* of the jack 80 by the mouth ring 30, the coaxial cable D1 at the plug 70 side is gradually forced toward the jack 80 by pressure exerted from squeezing of the cable D1 by protrusion 48. Such force also forces the front end surfaces 8*a* of the central conductors 8 in the coaxial cables D1 and D2 to strongly press against one another. Therefore, the plug 70 is prevented from pulling or twisting away from the coaxial cables D1 and D2, and conductivity between conductors 8 is safely and reliably maintained.

Figure 7:
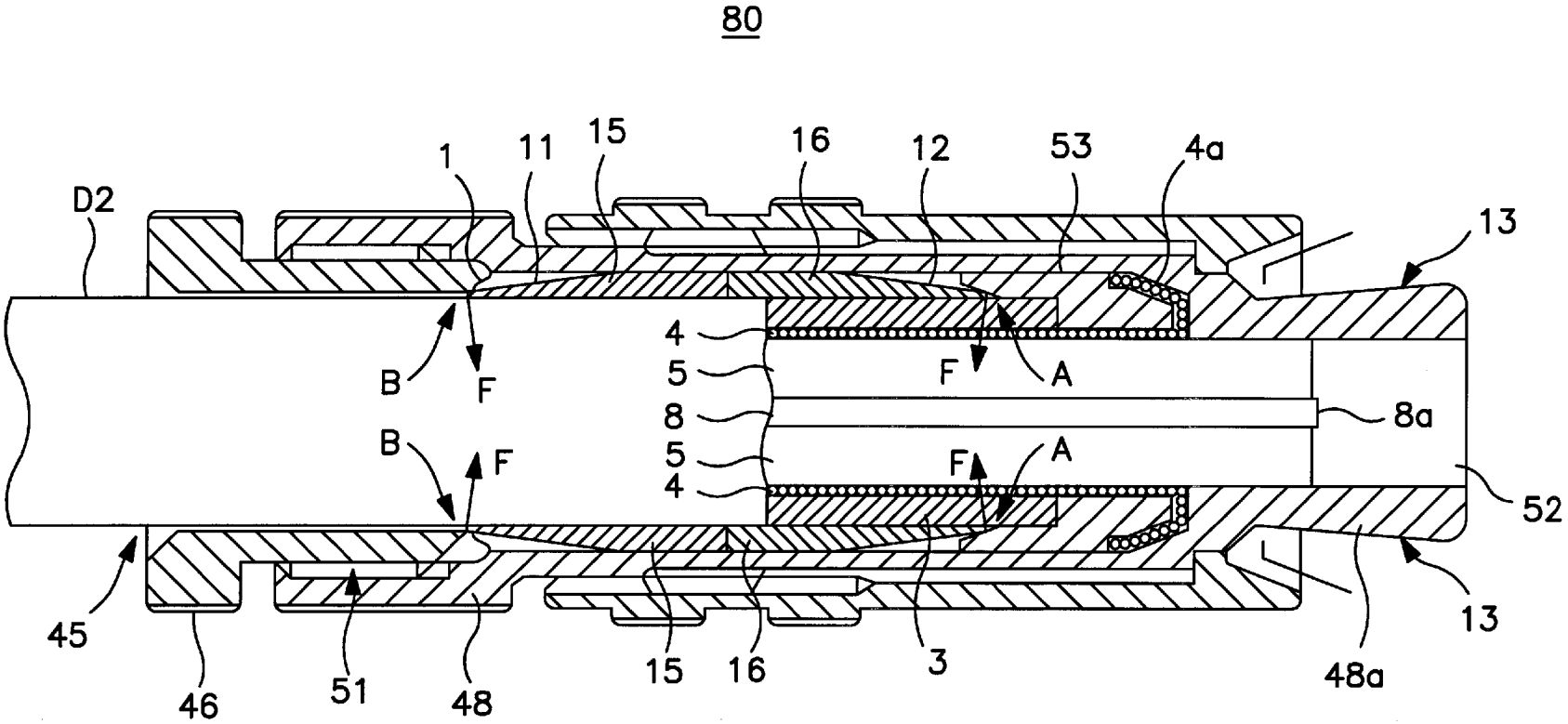
FIG. 7 is a cross-sectional side view of the plug of the coaxial connector of the third embodiment of the present invention.

Furthermore, in order ensure connective conductivity between the respective central conductors 8, it is necessary for the plug and the jack to be firmly affixed to the coaxial cables D1 and D2, respectively. The plug 50 and the jack 60 achieve this goal by the wedge effect of the retaining ring 55. However, in order to attain a high reliability with respect to the pulling strength, it is desirable that the outer insulator skin 3 of the coaxial cables D1 ad D2 be affixed to the jack or plug at a plurality of points. Therefore, the jack 80 in FIG. 6 and the plug 70 in FIG. 7 are provided with coupling means such that the first shells 26 and 46, as fastening threads mounted on the outside of the coaxial cable, are threadably engaged. Two tubular retaining members 15 and

16 having taper portions t1 and t2 are provided, which are internally mounted as wedges. These retaining members 15 and 16 enable firm fixation of the outer insulator skin 3 at a plurality of points (in FIGS. 6 and 7, two points, i.e., fastening portions A and B) by exerting a fastening force F.

The plug 70 and the jack 80 are coupled more firmly with the coaxial cables D1 and D2 in comparison with plug 50 and jack 60, since they are fastened to coaxial cables D1 and D2 at a plurality of points by retaining members 15 and 16. As a result, with regards to the third embodiment discussed above, it has been established by experimentation that such coaxial connector performs well in the horizontal loading test. Moreover, by enhancing the fastening strength of the outer periphery of the outer insulator skin 3 as described above, a phenomenon occurs such that the front end surface 8*a* of the central conductor 8 in the coaxial cables D1 and D2 is forced out from the insulator 5 by about 0.8 mm thus contributing to the conductivity between the end surfaces 8*a* of the central conductors 8.

The coaxial cables D1 and D2 used in the present invention may be manufactured from a semi-rigid cable or a flexible cable. Also, as is obvious such cables D1 may have a characteristic impedance other than 50 Ω or 75 Ω.

In conclusion, the coaxial connector of the present invention has the following features:

(1) Since the front end surfaces of the central conductor of the coaxial cable are directly conductively contacted without soldering, and the insulator and the outer conductor are connected in sequence and have the same diameter, the characteristic impedance is ideally matched and the reflection occurring on the coaxial connector portion upon transmission of a high frequency signal is reduced.

(2) There is no possibility of the coaxial cables being pulled out of the jack or plug since the coaxial cables are firmly coupled thereto. Further, there is no possibility of a loss of conduction since the connection is firmly maintained when subjected to pulling stress or twisting stress. Therefore, the coaxial connector of the present invention is highly reliable.

(3) The coaxial cable is connected and fixed to the plug and the jack by only inserting the tubular member therein and rotating and fastening the thread portion after stripping away the outer insulator skin of the coaxial cable. Therefore, soldering is not necessary.

(4) The plug and the jack are connected such that they are inserted into each other, and the thread is rotated to be fastened. Therefore, there is no need to solder and the wire connection can be performed easily.

What is claimed is:

1. A coaxial connector for connecting two end portions of two coaxial cables having a central conductor, an inner insulator surrounding the central conductor, an outer conductor surrounding the inner insulator and an outer insulator skin surrounding the outer conductor, the coaxial connector comprising:

a plug;

a jack;

a central conductor connecting means disposed in each of said plug and jack for directly conductively contacting front ends of the central conductors of each of the two coaxial cables disposed in the plug and jack, whose surfaces are exposed and surrounded by the insulator of the coaxial cable;

an outer conductor connecting means disposed in each of said plug and jack comprising a tubular member in each of the plug and the jack for maintaining a predetermined distance between the central conductor of each of the two coaxial cables and the jack or plug so as to maintain the same characteristic impedance as that of the coaxial cable and for conductively connecting the outer conductors of each of the two coaxial cables with each other by positioning the tubular members therebetween; and a coupling means for fastening and fixing the plug to the jack.

2. The coaxial connector according to claim 1, further comprising, as an outer conductor connecting means of the plug and the jack, a tubular member including a spring arranged within the plug and jack being inserted around the outer insulator skin of the central conductor, a shield cover having a force applied on one end thereof by the spring, inserted around the outer conductor, and a washer with teeth for depressing and gripping the outer conductor whose edge is folded backed onto the shield cover.

3. The coaxial connector according to claim 1, further comprising:

an outer conductor connecting means of the plug and the jack, said outer conductor means comprised of a tubular member and a retaining ring, the tubular member comprising a shield cover provided with a taper region arranged within the plug and jack and being inserted around the outer insulator skin of the central conductor and around the exposed outer conductor, wherein said taper region of the shield cover depresses and grips a folded back portion of an end of the outer conductor, at one opening end, to the inside of the plug and jack, and the retaining ring having an insertion portion being inserted around the outer insulator skin being provided with a gap to be pressed into the taper of the shield cover.

4. The coaxial connector according to claim 1, further comprising a coupling means for fastening the plug to the jack, said coupling means comprising a depression conductor member provided with a gap at the connecting side of the plug, a protrusion conductor member provided on the jack capable of being fitted into the depression conductor member of the plug at the connecting end side of the jack, a collet cap comprising a tubular body provided with a female thread arranged on the outer periphery of the plug, and a mouth ring having a taper portion for fastening an outer periphery of the depression conductor member on the inner periphery thereof.

5. The coaxial connector according to claim 1, further comprising a coupling means for fastening the plug to the jack, said coupling means comprising a depression conductor member being provided with a gap at the connecting side of the plug, a protrusion conductor member having an inverse taper provided on the jack capable of being fitted into the depression conductor member of the plug at the connecting end side of the jack, a collet cap comprising a tubular body provided with a female thread which is arranged on an outer periphery of the plug, and a mouth ring having a taper portion for fastening an outer periphery of the depression conductor member on an inner periphery.

6. The coaxial connector according to claim 1, wherein the plug and jack further comprise fixing means for fastening an inner periphery of the plug and jack to the outer insulator skin at a plurality of points, the fixing means comprising a plurality of tubular wedge-shaped retaining members internally mounted in the coaxial connector which engage coupling means at the taper portion of the wedge in a gap and/or a slit, thereby affixing a coaxial cable to the coaxial connector by exerting a force thereon.

7. A coaxial connector for connecting two coaxial cables, each coaxial cable having a central conductor, an inner insulator, an outer conductor and an outer insulator, said coaxial conductor comprising:

a plug having a connecting end side, a non-connecting end side, a depression disposed in the connecting side, and a gap defined at the connecting end side of the plug; and a jack having a connecting end side, a non-connecting end side, a cable insertion hole having a substantially same diameter as an outer diameter of the outer insulator of the coaxial cable to be connected for receiving the central conductor of the coaxial cable disposed within the plug, an insertion hole having a diameter equal to a diameter of the inner insulator of the coaxial cable disposed within the connecting end side of the jack, and the insertion hole having a protrusion for insertion into the gap of the plug, wherein the central conductors of each of the coaxial cables are in direct conductive contact.

* * * * *